US011802410B2

(12) United States Patent
Allen

(10) Patent No.: US 11,802,410 B2
(45) Date of Patent: Oct. 31, 2023

(54) RACKABLE RAILING ASSEMBLY

(71) Applicant: Ronald P. Allen, Greenville, SC (US)

(72) Inventor: Ronald P. Allen, Greenville, SC (US)

( * ) Notice: Subject to any disclaimer, the term of this patent is extended or adjusted under 35 U.S.C. 154(b) by 151 days.

(21) Appl. No.: 17/461,083

(22) Filed: Aug. 30, 2021

(65) Prior Publication Data

US 2023/0064587 A1 Mar. 2, 2023

(51) Int. Cl.
*E04F 11/18* (2006.01)

(52) U.S. Cl.
CPC ... *E04F 11/1834* (2013.01); *E04F 2011/1827* (2013.01)

(58) Field of Classification Search
CPC ..... E04F 11/1817; E04F 11/1834; E04F 2011/1819; E04F 2011/1821; E04F 2011/1823; E04F 2011/1825; E04F 2011/1827; E04H 17/1426; E04H 17/1439; E04H 17/1445
See application file for complete search history.

(56) References Cited

U.S. PATENT DOCUMENTS 2,563,530 A * 8/1951 Hawkins ..... E04F 11/1834 403/186
3,244,406 A * 4/1966 Garofola ..... E04F 11/1817 256/21
3,858,850 A 1/1975 Maxcy et al.
4,014,520 A * 3/1977 Walters ..... E04F 11/1817 256/22
4,344,604 A * 8/1982 Basey ..... E04F 11/1834 256/65.01
4,421,302 A * 12/1983 Grimm ..... E04F 11/1834 403/71
4,723,760 A 2/1988 O'Sullivan
5,056,283 A 10/1991 Sapinski
5,443,244 A * 8/1995 Gibbs ..... E04H 17/1439 256/22

(Continued)

FOREIGN PATENT DOCUMENTS

DE 29611012 U1 * 8/1996 ..... E04F 11/1834
KR 200189557 Y1 7/2000
WO WO-2009092053 A1 * 7/2009 ..... E04F 11/1834

OTHER PUBLICATIONS

International Search Report for PCT/US/22/35234 dated Oct. 28, 2022.

(Continued)

*Primary Examiner* — Amber R Anderson
*Assistant Examiner* — Kevin J Baynes
(74) *Attorney, Agent, or Firm* — Kim and Lahey Law Firm, LLC; Seann P Lahey

(57) ABSTRACT

A rackable railing assembly including a rail having a hollow interior. A series of picket slots are disposed in the rail. A tab strip is carried in the rail. A series of tab slots are laterally spaced along the tab strip. A tab is secured at one end of each of the tab slots and extends partially across the tab slots so that the tabs are bendable in the tab slots. A series of pickets are included having a distal end portion extending through the picket slots in the rail and having an end surface secured against one of the tabs. The pickets pivot in the picket slots causing the tabs to bend relative to the plain of the tab strip to allow the pickets and rail to rack to an angle.

17 Claims, 8 Drawing Sheets

(56) References Cited

U.S. PATENT DOCUMENTS 5,649,688 A * 7/1997 Baker ..... E04F 11/181 256/22
5,660,378 A * 8/1997 Schall ..... E04H 17/1439 256/22
5,713,171 A * 2/1998 Andres ..... E04H 17/1447 256/65.14
6,029,954 A 2/2000 Murdaca
6,231,031 B1 * 5/2001 Michael ..... E04H 17/143 256/60
6,752,385 B2 6/2004 Zen et al.
6,874,766 B2 * 4/2005 Curatolo ..... E04F 11/1817 256/64
6,969,051 B1 * 11/2005 Gibbs ..... E04H 17/1439 256/65.01
7,021,607 B1 * 4/2006 Alexander ..... E04H 17/1439 256/70
7,475,870 B2 * 1/2009 Platt ..... E04F 11/1834 256/60
7,543,802 B2 * 6/2009 Petta ..... E04F 11/1814 256/65.03
7,621,510 B2 * 11/2009 Gibbs ..... E04H 17/1417 256/65.1
7,677,535 B1 * 3/2010 Lo ..... E04H 17/1439 256/65.01
8,403,303 B2 * 3/2013 Payne ..... E04H 17/1488 256/65.09
8,695,948 B2 4/2014 Stinson
9,574,353 B1 * 2/2017 Umosella ..... E04F 11/1817
9,689,177 B2 * 6/2017 Langenwalter ..... E04H 17/1426
9,695,612 B2 * 7/2017 Batts, III ..... E04H 17/1439
9,995,059 B2 6/2018 Langenwalter et al.
10,533,340 B1 1/2020 Ohanesian
10,604,941 B2 3/2020 Schneider et al.
2003/0196395 A1 * 10/2003 Forbis ..... E04F 11/1817 256/59
2004/0188663 A1 * 9/2004 Stein ..... E04H 17/1439 256/59
2007/0200105 A1 * 8/2007 Williams ..... B21D 39/044 256/22
2008/0157049 A1 * 7/2008 Robbins ..... E04H 17/1439 256/65.12
2009/0026431 A1 1/2009 Tremblay et al.
2009/0064607 A1 * 3/2009 Katz ..... E04F 11/1834 52/184
2010/0237309 A1 * 9/2010 Ferris ..... E04F 11/1817 256/65.01
2012/0286117 A1 11/2012 Leary
2012/0326108 A1 12/2012 Eves et al.
2013/0181179 A1 * 7/2013 Langenwalter ..... E04H 17/1426 256/67
2016/0097216 A1 * 4/2016 Molina ..... E04F 11/1817 29/428
2019/0145123 A1 * 5/2019 Lo ..... E04H 17/1447 256/67

OTHER PUBLICATIONS

Written Opinion of the International Searching Authority (ISA/US) for PCT/US/22/35234 dated Oct. 28, 2022.

* cited by examiner

RACKABLE RAILING ASSEMBLY

BACKGROUND OF THE INVENTION

1) Field of the Invention

The present invention relates to railing and fencing construction, and more particularly, to a rackable railing assembly in which pickets are interconnect with rails in a manner to provide for an angular adjustment so that an assembled railing panel can then be angled or "racked" to accommodate an inclined surface.

2) Description of Related Art

Rackable railing and fencing assemblies of various constructions have previously been developed in the art. However, the known systems tend to be unnecessary complicated with excessive manufacturing required to produce the pivoting motion of the pickets in relation to the attached rails, as well as the need for various extra parts that require extensive construction assembly efforts as compared to a non-rackable railing assembly. Because of these complicated manufacturing and assembly issues, some installers will instead hand cut each picket and rail of a railing assembly to a desired angle for a given slope. While this eliminated the complexity associated with the rackable aspects, it creates room for mistakes and is highly time consuming, considerably increasing installation labor costs.

Accordingly, it is an object of the present invention to provide a rackable railing assembly that is easily adjustable to accommodate various angles of sloped surfaces for installation.

It is a further object of the present invention to provide a rackable railing assembly that reduces manufacturing and assembly costs without sacrificing stability and sturdiness.

SUMMARY OF THE INVENTION

The above objectives are accomplished according to the present invention by providing a rackable railing assembly comprising a rail having a hollow interior; a series of picket slots disposed in said rail; a tab strip carried in said rail; a series of tab slots being laterally spaced along said tab strip; a tab secured at one end of each of said tab slots and extending partially across said tab slots so that said tabs are bendable in said tab slots; a fastener opening disposed in each of said tabs; a series of pickets having a distal end portion extending through said picket slots in said rail and having an end surface abutting one of said tabs; a fastener channel carried on an interior side of each of said pickets adjacent said end surface, wherein said fastener channel aligns with said fastener opening of said tab and a securing member extends through said fastener opening and into said fastener channel to secure each of said pickets to one of said tabs; wherein said pickets pivot in said picket slots causing said tabs to bend relative to the plain of said tab strip to allow said pickets and rail to rack to an angle.

In a further advantageous embodiment, a first channel is carried on a first sidewall in said rail, and a second channel is carried on a second sidewall in said rail opposite said first channel, wherein said tab strip is carried by said first and second channels.

In a further advantageous embodiment, said first channel and said second channel have a C-shape with a slot opening receiving said tab strip.

In a further advantageous embodiment, said distal end portion of said pickets extends at least partially through said tab slots when said pickets pivot in said picket slots and said tabs are bent to an angle relative to said tab strip.

In a further advantageous embodiment, said picket slots and said tab slots are elongated in a direction along the length of said rail and said tab strip defining a pivot gap between said pickets and at least one end of each of said picket slots and said tab slots.

In a further advantageous embodiment, said picket slots and said tab slots are rectangular and said pickets are square defining a pivot gap between said pickets and at least one end of each of said picket slots and said tab slots.

In a further advantageous embodiment, said rail includes an open top side and a rail cap mounted to said rail that covers said open top side.

In a further advantageous embodiment, said rail cap includes a raised central portion extending over said open top side of said rail and defining a receiving area into which said distal end portion of said pickets and said tabs enter when said pickets are pivoted.

In a further advantageous embodiment, said tab strip is carried in said rail adjacent said receiving area such that pivotal movement of said pickets directs said tabs and said distal end portion of said pickets into said receiving area.

The above objectives are further accomplished according to the present invention by providing a rackable railing assembly comprising an upper rail having a hollow interior defined by a pair of sidewalls, a bottom wall, and an open top side; a lower rail having a hollow interior defined by a pair of sidewalls, a top wall, and an open bottom side; a series of picket slots disposed in said bottom wall of said upper rail and in said top wall of said lower rail; a first channel carried on a first of said sidewalls in said upper and lower rails; a second channel carried on a second of said sidewalls in said upper and lower rails opposite said first channel; a tab strip carried by said first and second channels in both said upper and lower rails adjacent said open top side of said upper rail and said open bottom side of said lower rail; a series of tab slots being laterally spaced along each said tab strip; a tab secured at one end of each of said tab slots and extending partially across said tab slots so that said tabs are bendable in said tab slots; a fastener opening disposed in each of said tabs; a series of pickets having a first distal end portion extending through said picket slots in said bottom wall of said upper rail and having an end surface abutting one of said tabs, and said pickets having a second distal end portion extending through said picket slots in said top wall of said lower rail and having an end surface abutting one of said tabs; a fastener channel carried on an interior side of each of said pickets adjacent said end surface of said first and second distal end portions, wherein said fastener channel aligns with said fastener opening of said tab and a securing member extends through said fastener opening and into said fastener channel to secure each of said pickets to one of said tabs; wherein said pickets pivot in said picket slots of said upper and lower rails causing said tabs to bend relative to the plain of said tab strip to allow said pickets and rails to rack to an angle.

In a further advantageous embodiment, said tabs extend in the same direction along said tab strips, and wherein said tab strips are oriented in both said upper and lower rails so that said tabs on both said tab strips extend in the same direction.

In a further advantageous embodiment, said first and second distal end portions of said pickets extend at least partially through said tab slots when said pickets pivot in said picket slots and said tabs are bent to an angle relative to said tab strip.

In a further advantageous embodiment, said picket slots and said tab slots are elongated in a direction along the length of said upper rail and said tab strip defining a pivot gap between said pickets and at least one end of each of said picket slots and said tab slots in the upper rail.

In a further advantageous embodiment, a rail cap is mounted to said upper rail that covers said open top side and includes a raised central portion extending over said open top side of said upper rail defining a receiving area into which said first distal end portion of said pickets and said tabs on said tab strip of said upper rail enter when said pickets are pivoted.

The above objectives are further accomplished according to the present invention by providing a rackable railing assembly comprising a rail having a hollow interior; a series of picket slots disposed in said rail; a tab strip carried in said rail; a series of tab slots being laterally spaced along said tab strip; a tab secured at one end of each of said tab slots and extending partially across said tab slots so that said tabs are bendable in said tab slots; a series of pickets having a distal end portion extending through said picket slots in said rail and having an end surface secured against one of said tabs; wherein said pickets pivot in said picket slots causing said tabs to bend relative to the plain of said tab strip to allow said pickets and rail to rack to an angle.

In a further advantageous embodiment, a fastener opening is disposed in each of said tabs.

In a further advantageous embodiment, a fastener channel is carried on an interior side of each of said pickets adjacent said end surface, wherein said fastener channel aligns with said fastener opening of said tab and a securing member extends through said fastener opening and into said fastener channel to secure each of said pickets to one of said tabs.

In a further advantageous embodiment, a first channel is carried on a first sidewall in said rail, and a second channel is carried on a second sidewall in said rail opposite said first channel, wherein said tab strip is carried by said first and second channels.

In a further advantageous embodiment, said distal end portion of said pickets extends at least partially through said tab slots when said pickets pivot in said picket slots and said tabs are bent to an angle relative to said tab strip.

In a further advantageous embodiment, said picket slots and said tab slots are elongated in a direction along the length of said rail and said tab strip defining a pivot gap between said pickets and at least one end of each of said picket slots and said tab slots.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
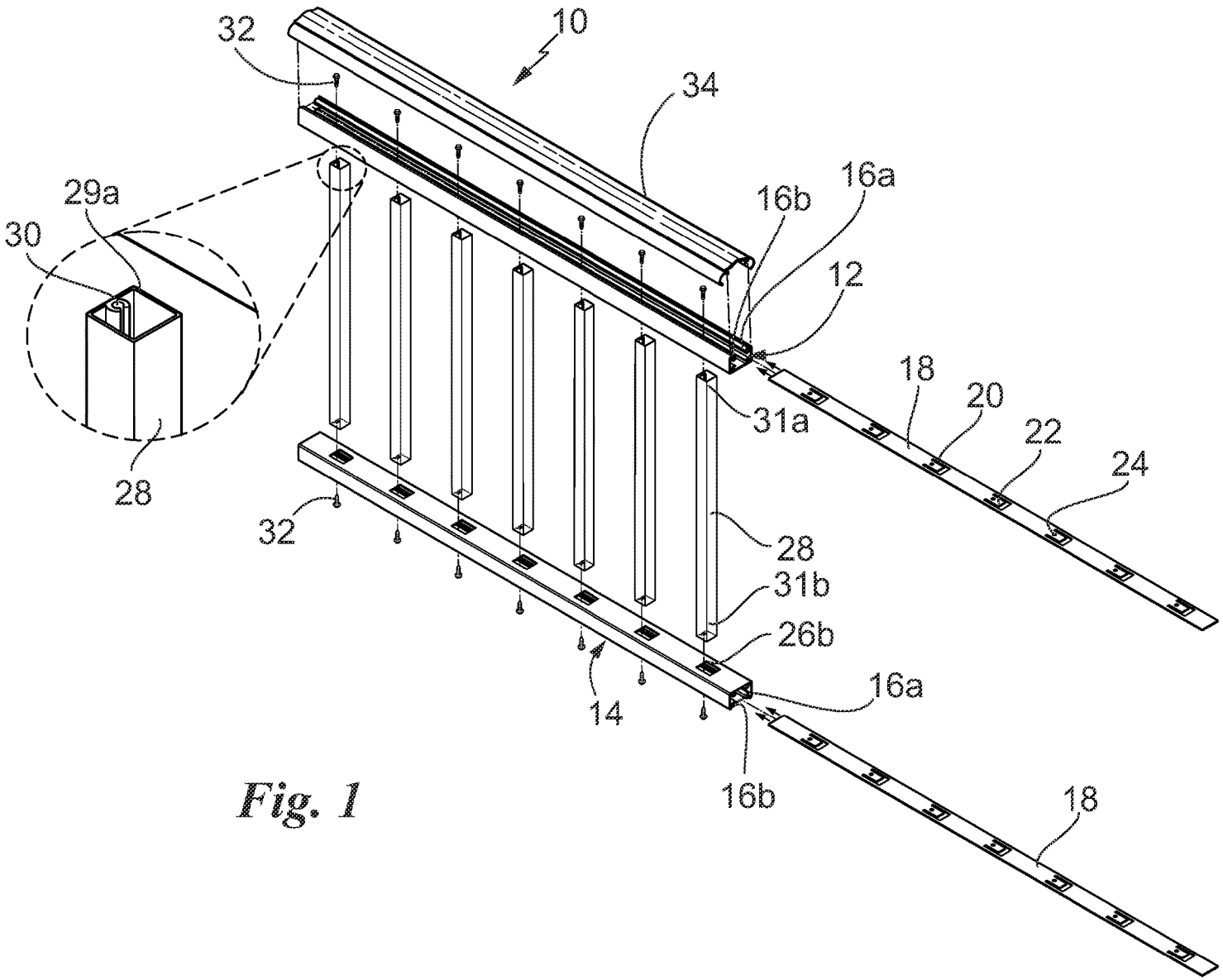
FIG. 1 shows an exploded view of the rackable railing assembly according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 6A:
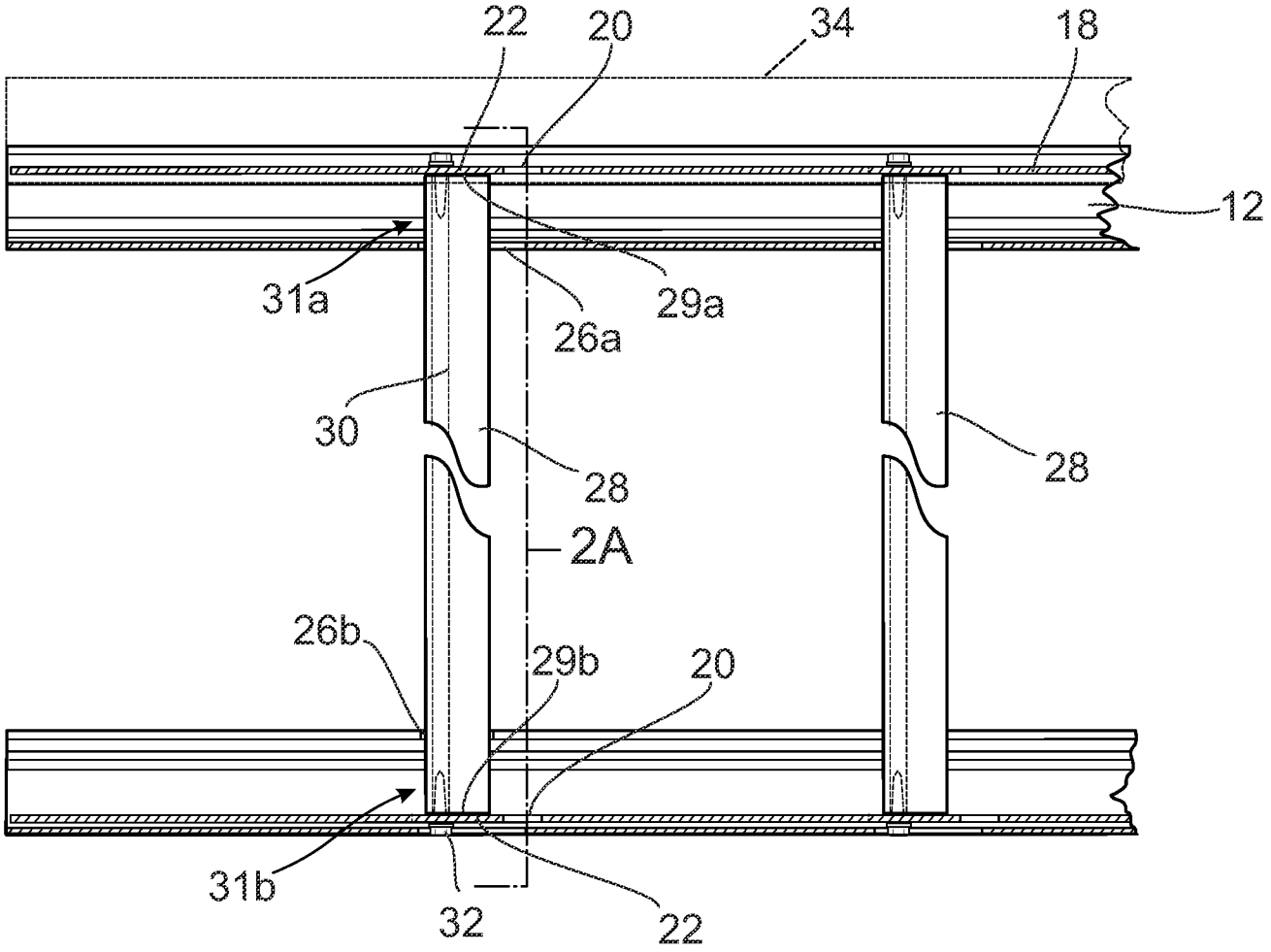
FIG. 6A a shows a cut-away view of a portion of the rackable railing assembly prior to racking according to the present invention.

Referring to FIG. 1, the rackable railing assembly 10 of the present invention is shown in an example embodiment that includes a top rail 12 and a bottom rail 14 interconnected by a series of pickets 28. Within each rail, a tab strip 18 is securely carried in channels 16*a*, 16*b* formed in the walls of the rails. The tab strip 18 includes a series of bendable tabs 22 disposed in tab slots 20. The distal ends of the pickets 28 are secured to the tabs 22 with a securing member 32, such as a screw, to securely lock the pickets 28 and the rails 12, 14 together. Because the tabs 22 on the tab strip 18 are bendable, the pickets can pivot in picket slots 26*a*, 26*b* (FIG. 2) disposed in the rails 12, 14. Thus, as the pickets 28 pivot relative to the rails 12, 14, the railing assembly 10 can move from a level non-racked arrangement (FIGS. 3A, 6A) to a racked position (FIG. 3B, 6B) to accommodate a given angle of an inclined surface, such as a flight of stairs.

The term(s) "rackable," "racked" and "rack" as used herein in relation to the present invention means that the railing assembly can be adjusted after the pickets 28 are attached to the tabs 22 of the tab strips 18 in the rails 12, 14 to change the angle of the rails relative to the pickets to accommodate a flight of stairs or otherwise angle the railing on a slope. Also, while the present invention is described in terms of a "railing" assembly, the present invention applies equally to fencing. Accordingly, the terms "railing" and "fencing" are considered interchangeable for purposes of the scope of the present invention and the understanding to one skilled in the art.

Figure 2B:
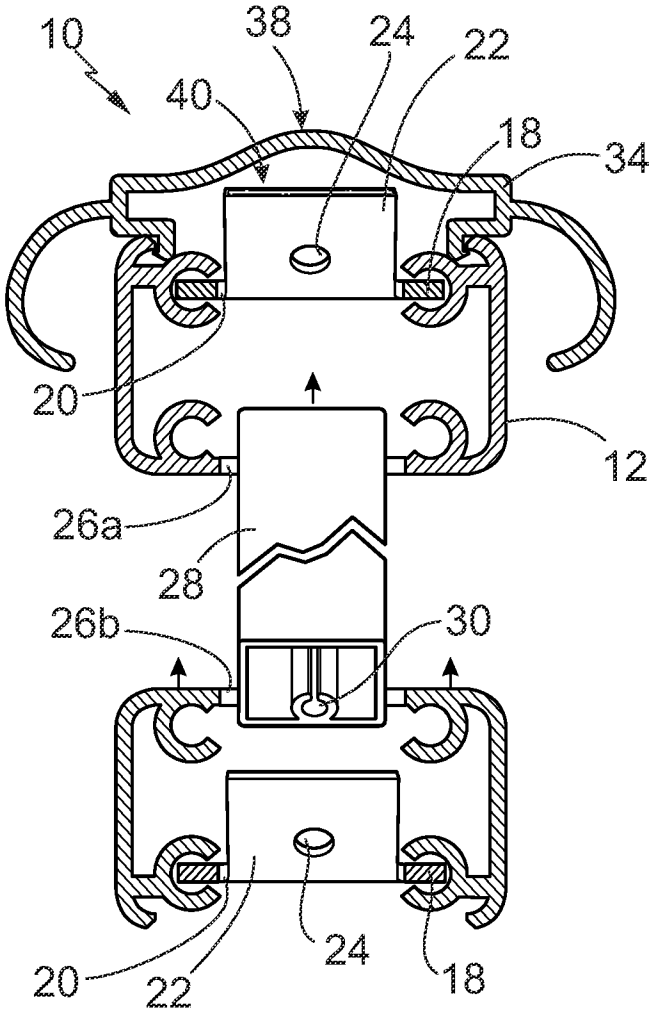
FIG. 2B shows an exploded cross-section view of the rackable railing assembly after racking to an angle according to the present invention.
Figure 2A:
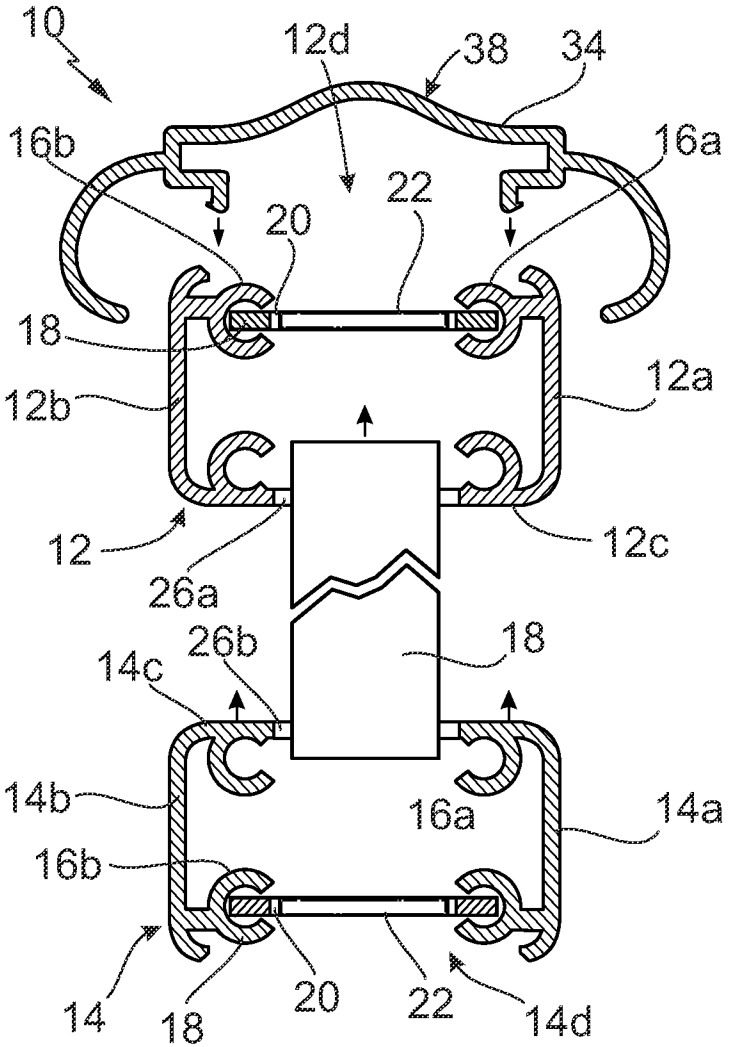
FIG. 2A show an exploded cross-section view of the rackable railing assembly prior to racking according to the present invention.
Figure 3A:
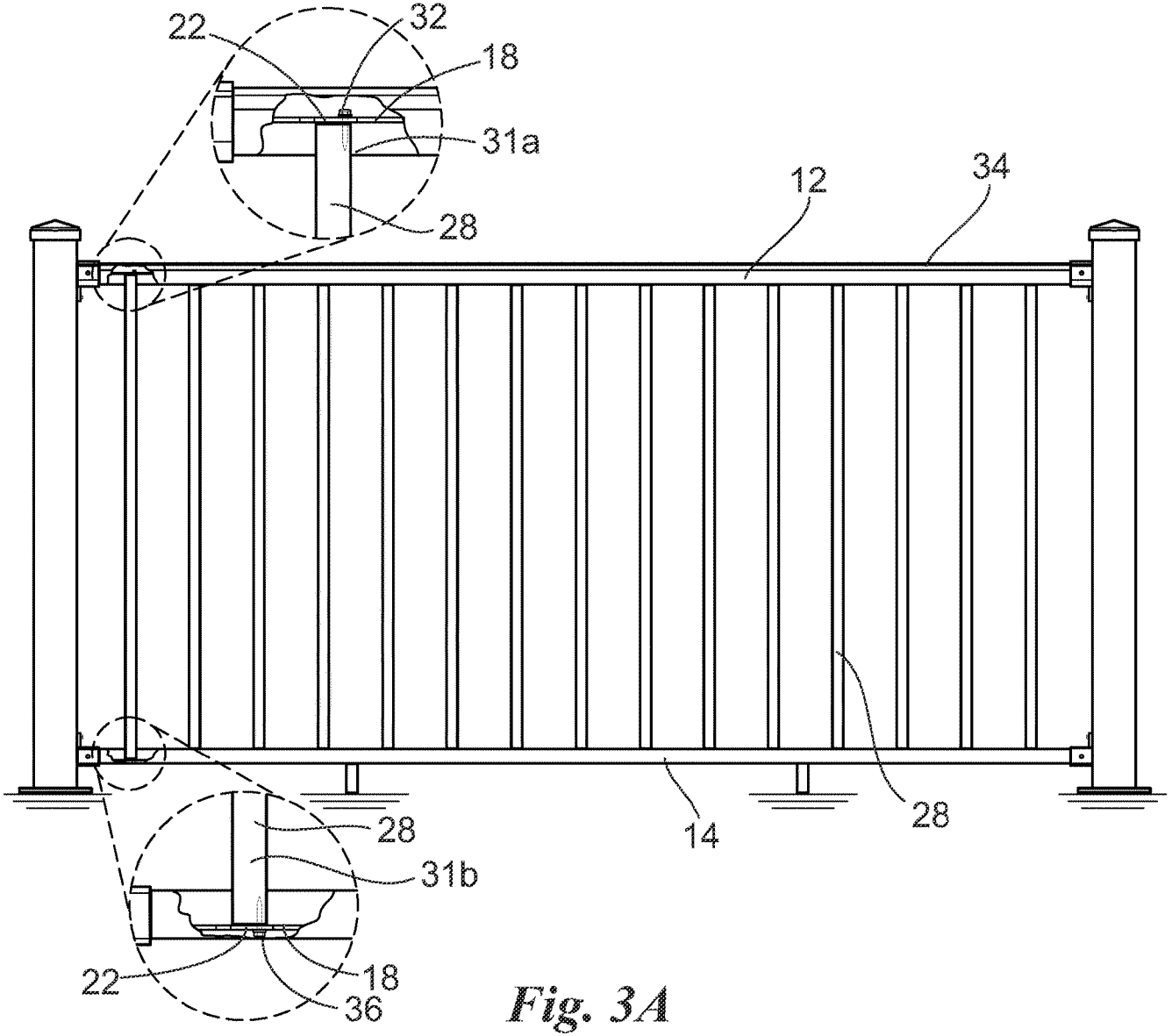
FIG. 3A shows a side view of the rackable railing assembly prior to racking according to the present invention.

Referring to FIGS. 2A and 2B, an end cross-section view of the rackable railing assembly, designated generally as 10, is shown. In the illustrated embodiment, rackable railing assembly 10 comprising an upper rail, designated generally as 12, having a hollow interior defined by a pair of sidewalls 12*a*, 12*b*, a bottom wall 12*c*, and an open top side, designated generally as 12*d*. The rackable railing assembly 10 also includes a lower rail, designated generally as 14. Lower rail 14 has a hollow interior defined by a pair of sidewalls 14*a*, 14*b*, a top wall 14*c*, and an open bottom side, designated generally as 14*d*.

As best shown in FIGS. 2A and 2B, in the illustrated embodiment, a first channel 16*a* is carried on a first of the sidewalls 12*a* in the upper rail 12. A second channel 16*b* is carried on a second of the sidewalls 12*b*, which is positioned opposite the first channel 16*a* in the upper rail. The lower rail 14 also includes a first channel 16*a* carried on a first sidewall 14*a* with a second channel 16*b* carried on a second of the sidewalls 14*b* such that the first and second channels 16*a*, 16*b* are positioned opposite each other in the lower rail. As shown, the first channel and the second channel 16*a*, 16*b* can have a C-shape with a slot opening.

Figure 3B:
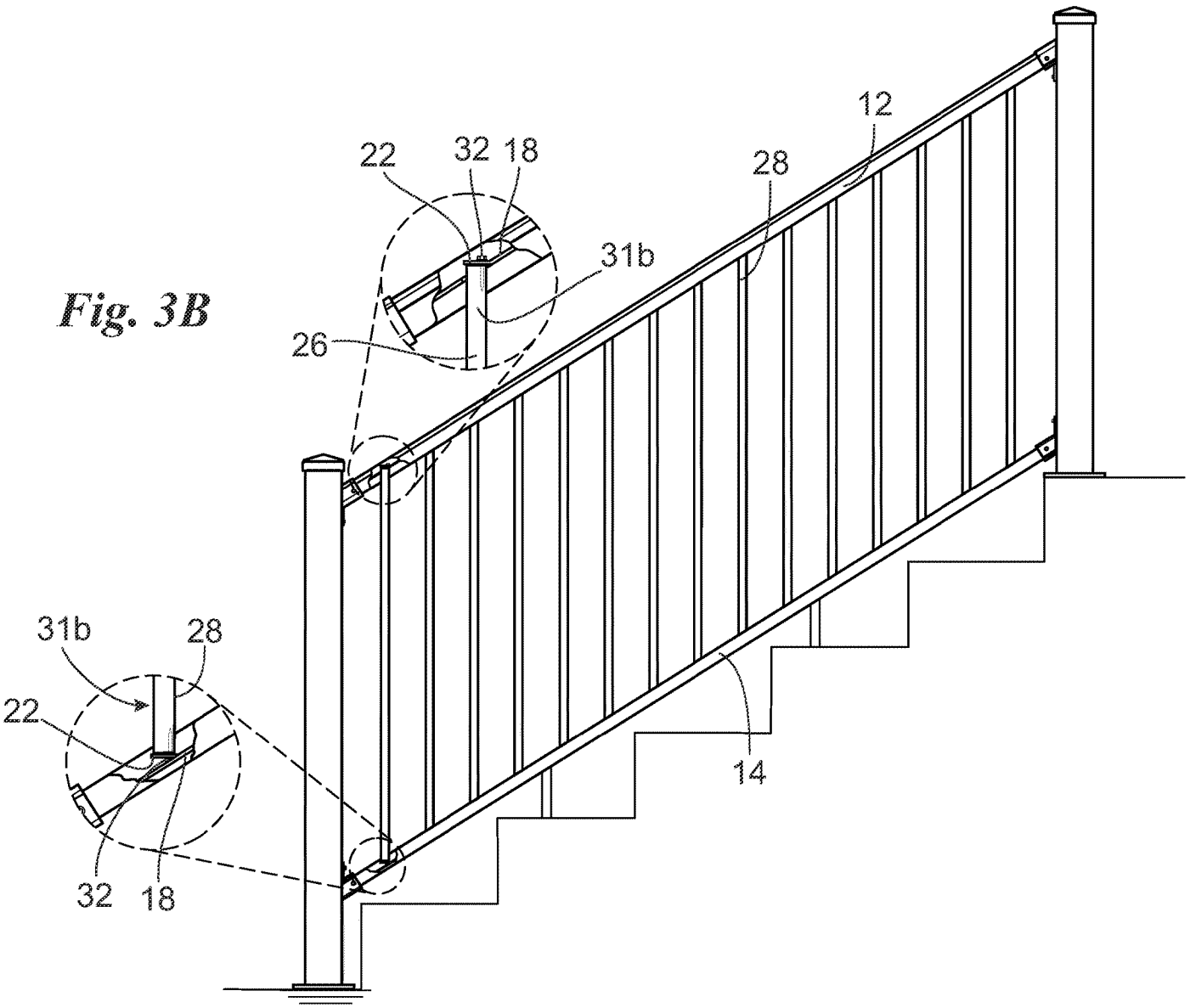
FIG. 3B shows a side view of the rackable railing assembly after racking to an angle according to the present invention.
Figure 6B:
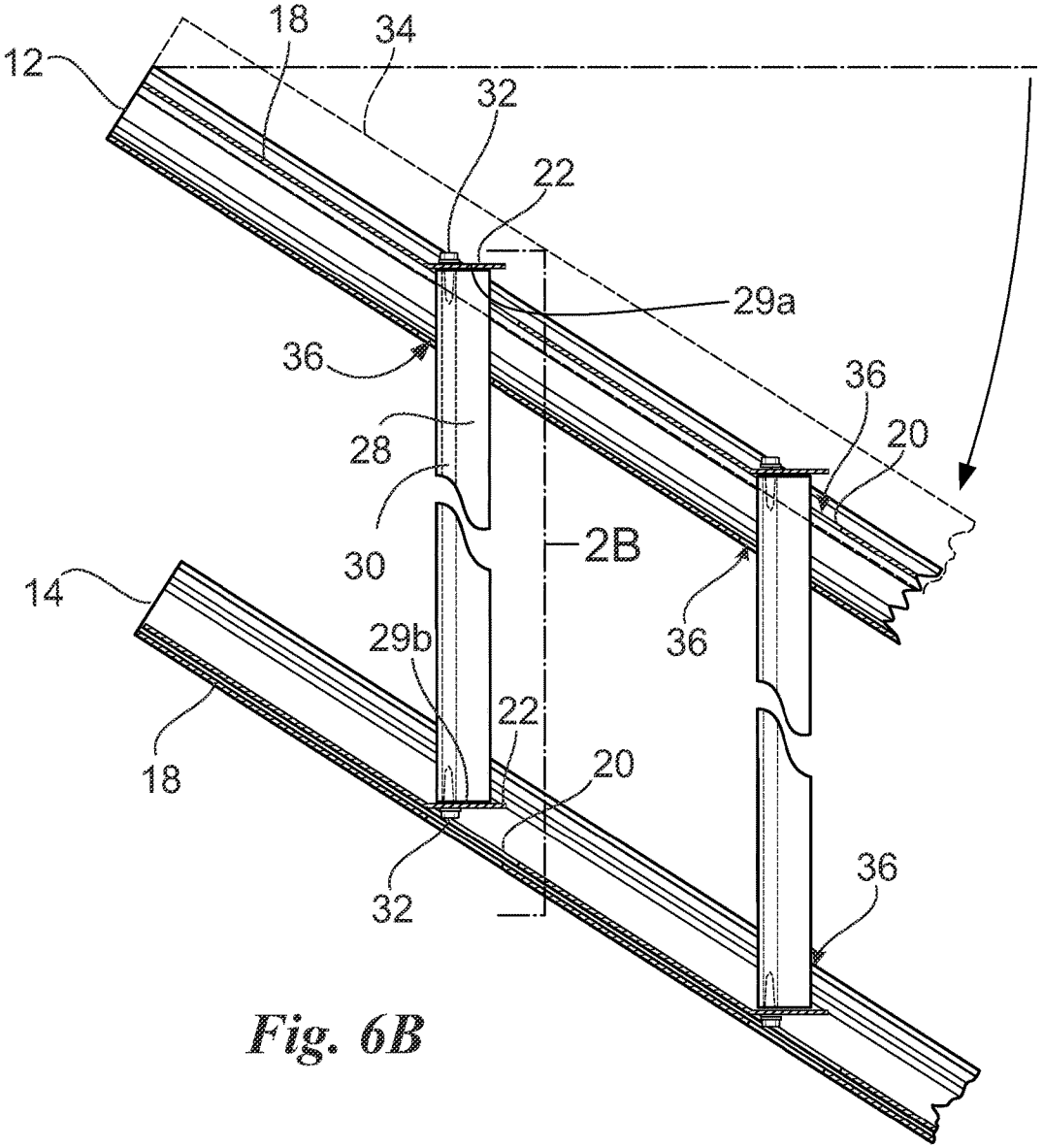
FIG. 6B a shows a cut-away view of a portion of the rackable railing assembly after racking to an angle according to the present invention.
Figure 7A:
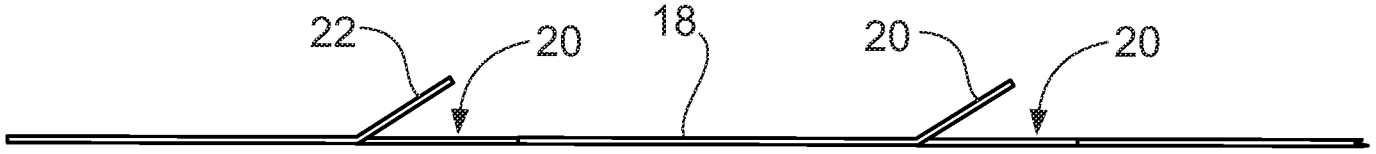
FIG. 7A shows a side view of a portion of the tab strip according to the present invention; and, FIG. 7B shows a top view of a portion of the tab strip according to the present invention.
Figure 7B:
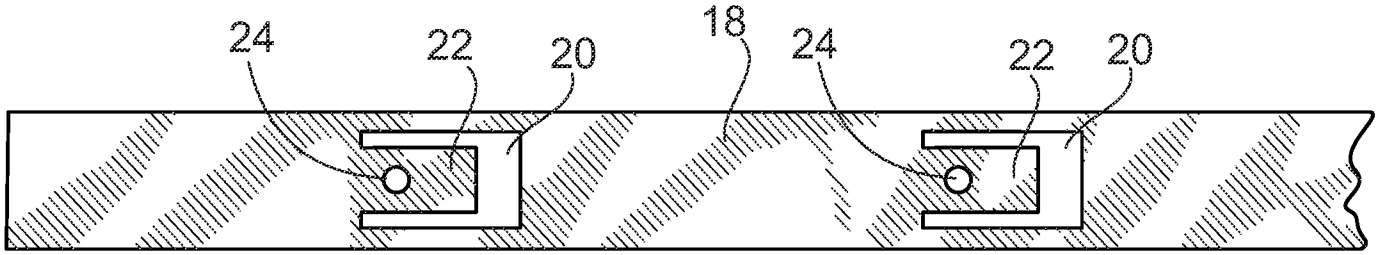

Referring to FIGS. 2A and 2B, tab strip 18 is received in and carried by the first and second channels 16*a*, 16*b* in both the upper and lower rails 12, 14. In the illustrated embodiment, the first and second channels 16*a*, 16*b* are located adjacent the open top side 12*d* of upper rail 12. In lower rail 14, the first and second channels 16*a*, 16*b* are located adjacent the open bottom side 14*d*. The placement of the tab strip 18 in the upper and lower rails 12, 14 allows the distal ends of the pickets 28 to extend into open space within the rail or under rail cap 34 when the railing panel is racket, as shown in FIGS. 3B, 4, and 6B.

Referring to FIGS. 2A, 2B, 5A and 7B, a series of tab slots 20 are laterally spaced along each tab strip 18. A bendable tab 22 is secured at one end of each of the tab slots 20. A fastener opening 24 is disposed in each of the tabs. In the illustrated example embodiment, each tab 22 extending partially across the tab slots 20 such that the tabs 22 are bendable in the tab slots 20. As best shown in FIG. 1, for the railing assembly to rack properly, the tabs 22 should extend in the same direction along the tab strip 18 carried in both the upper and lower rails 12, 14. Additionally, the tab strips 18 are oriented in both the upper and lower rails 12, 14 so that the tabs 22 on both the tab strips extend in the same direction. The length of the tabs 22 help determine how much angle is possible when racking the railing assembly. In the illustrated embodiment, the railing assembly is rackable to an angle of about 40 degrees.

Referring to FIGS. 1, 2A, 2B, 4, 5B, 6A and 6B, a series of picket slots 26*a*, 26*b* are disposed in the bottom wall 12*c* of the upper rail 12 and in the top wall 14*c* of the lower rail 14, respectively. A series of pickets 28 are provided having a first distal end portion, designated generally as 31*a*, extending through the picket slots 26*a* in the bottom wall 12*c* of the upper rail 12. An end surface 29*a* is arranged abutting one of the tabs 22 in the upper rail 12 so that the end surface 29*a* is flush mounted against tab 22. The pickets 28 then have a second distal end portion, designated generally as 31*b*, extending through the picket slots 26*b* in the top wall 14*c* of the lower rail 14. An end surface 29*b* is arranged abutting one of the tabs 22 in the lower rail 14 so that the end surface 29*b* is flush mounted against tab 22. The tabs 22 do not engage with the side surfaces of the pickets, but just attached directly against the end surface 29*a*, 29*b*.

Figure 4:
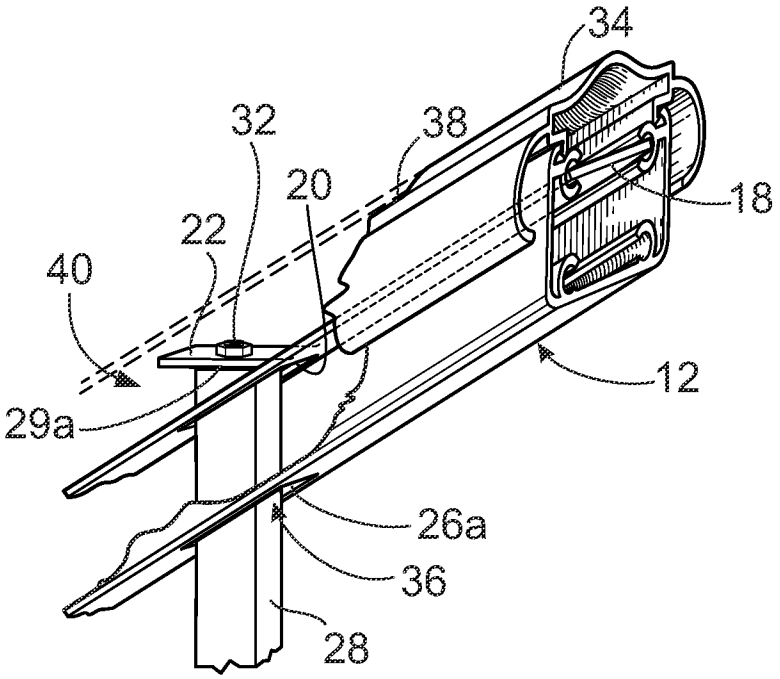
FIG. 4 shows a detailed cut-away view of a portion of an upper rail and picket racked to on an angle according to the present invention.

Referring to FIGS. 1 and 4, a fastener channel 30 is carried on an interior side of each of the pickets 28. In the illustrated embodiment, fastener channel 30 is disposed adjacent the end surface 29*a*, 29*b* of the first and second distal end portions of the pickets 28. The fastener channel 30 is constructed and arranged to align with the fastener opening 24 (best shown in FIG. 7B) of the tab 22. A securing member 32 extends through the fastener opening 24 and into the fastener channel 30 to secure each of the pickets 28 to one of the tabs 22 to interconnect the upper and lower rails 12, 14. Accordingly, with further reference to FIGS. 3A, 3B, 6A and 6B, the pickets 28 pivot in the picket slots 26*a*, 26*b* of the upper and lower rails 12, 14 causing the tabs 22 to bend relative to the plain of the tab strip 18 to allow the pickets 28 and rails 12, 14 to rack to an angle.

Referring to FIGS. 3B, 4, and 6B, in the illustrated embodiment, the first and second distal end portions 31*a*, 31*b* of the pickets 28 extend at least partially through the tab slots 20 when the pickets 28 pivot in the picket slots 26*a*,

26*b* and the tabs 22 are bent to an angle relative to the tab strip 18 when the railing assembly is racked.

Figure 5A:
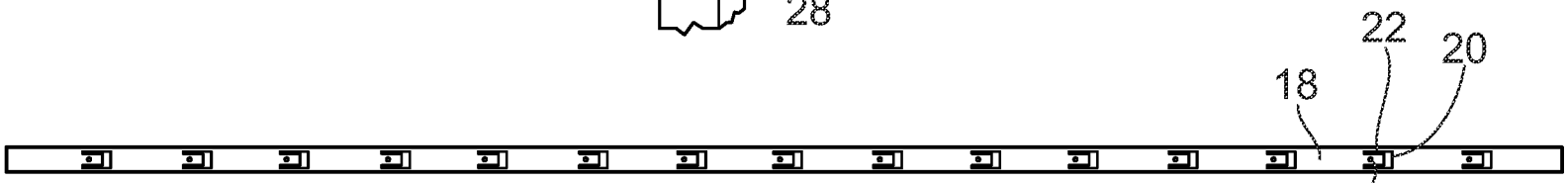
FIG. 5A shows a top view of a tab strip according to the present invention.
Figure 5B:
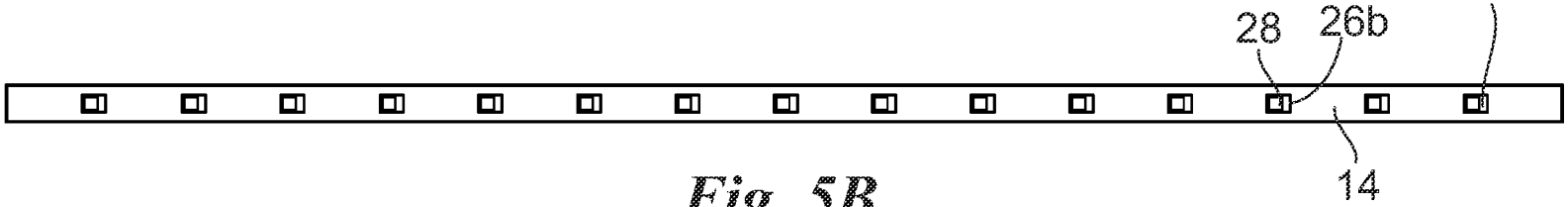
FIG. 5B shows a bottom view of a rail according to the present invention.

Referring to FIGS. 5A and 5B, the picket slots 26*a*, 26*b* and the tab slots 20 are elongated in a direction along the length of the upper and lower rails 12, 14 and the tab strip 18. In the illustrated embodiment, the tab slots 20 and picket slots 26*a*, 26*b* are rectangular in shape. With further reference to FIGS. 4, 5B and 6B, as the pickets are square shaped in the illustrated embodiment, a pivot gap 36 is defined between the pickets 28 and at least one end of each of the picket slots 26*a*, 26*b* in both the upper and lower rails. In the upper rail, there is also a pivot gap 36 between the pickets and the tab slots 20.

Referring to FIGS. 2A, 2*b* and 4, a rail cap 34 is mounted to the upper rail 12 that covers the open top side 12*d* and includes a raised central portion 38 extending over the open top side 12*d* of the upper rail 12. The raised central portion 38 defines a receiving area, designated generally as 40, into which the first distal end portion 31*a* of the pickets 28 and the tabs 22 on the tab strip 18 of the upper rail 12 enter when the pickets are pivoted when the railing assembly is racked. In the illustrated embodiment, the tab strip 18 is carried in the upper rail 12 adjacent the open top side 12*d* and thus the receiving area 40 such that pivotal movement of the pickets 28 directs the tabs 22 and the first distal end portion 31*a* of the pickets 28 into the receiving area 40.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A rackable railing assembly comprising:

a rail having a hollow interior defined by a first sidewall, a second sidewall, a bottom wall, and an open top side extending along a plane disposed at and between the distal ends of the first and second sidewalls;

a series of picket slots disposed in said bottom wall of said rail;

a first channel carried on said first sidewall in said rail, and a second channel carried on said second sidewall in said rail opposite said first channel a tab strip disposed in said hollow interior and having a first side carried in said first channel and a second side carried in said second channel, wherein said tab strip is disposed adjacent said open top side 3;

a series of tab slots being laterally spaced along said tab strip;

a tab secured at one end of each of said tab slots and extending partially across said tab slots so that said tabs are bendable in said tab slots;

a fastener opening disposed in each of said tabs;

a series of pickets having a distal end portion extending through said picket slots in said rail and having an end surface abutting one of said tabs;

a fastener channel carried on an interior side of each of said pickets adjacent said end surface, wherein said fastener channel aligns with said fastener opening of said tab and a securing member extends through said fastener opening and into said fastener channel to secure each of said pickets to one of said tabs;

wherein said pickets pivot in said picket slots causing said tabs to bend relative to a plane of said tab strip to allow said pickets and rail to rack to an angle.

2. The rackable railing assembly of claim 1 wherein said first channel and said second channel have a C-shape with a slot opening receiving said tab strip.

3. The rackable railing assembly of claim 1 wherein said distal end portion of said pickets extends at least partially through said tab slots when said pickets pivot in said picket slots and said tabs are bent to an angle relative to said tab strip.

4. The rackable railing assembly of claim 1 wherein said picket slots and said tab slots are elongated in a direction along the length of said rail and said tab strip defining a pivot gap between said pickets and at least one end of each of said picket slots and said tab slots.

5. The rackable railing assembly of claim 1 wherein said picket slots and said tab slots are rectangular and said pickets are square defining a pivot gap between said pickets and at least one end of each of said picket slots and said tab slots.

6. The rackable railing assembly of claim 1 wherein said rail includes a rail cap mounted to said rail that covers said open top side.

7. The rackable railing assembly of claim 6 wherein said rail cap includes a raised central portion extending over said open top side of said rail and defining a receiving area between said plane defining said open top side of said rail and an interior surface of said rail cap, wherein said distal end portion of said pickets and said tabs extend through said plane of said open top side and enter said receiving area when said pickets are pivoted.

8. A rackable railing assembly comprising:

an upper rail having a hollow interior defined by a pair of sidewalls, a bottom wall, and an open top side extending along a plane disposed at and between the distal ends of the sidewalls;

a lower rail having a hollow interior defined by a pair of sidewalls, a top wall, and an open bottom side extending along a plane disposed at and between the distal ends of the sidewalls;

a series of picket slots disposed in said bottom wall of said upper rail and in said top wall of said lower rail;

a first channel carried on a first of said sidewalls in said upper and lower rails;

a second channel carried on a second of said sidewalls in said upper and lower rails opposite said first channel;

a tab strip carried by said first and second channels in both said upper and lower rails adjacent said open top side of said upper rail and said open bottom side of said lower rail;

a series of tab slots being laterally spaced along each said tab strip;

a tab secured at one end of each of said tab slots and extending partially across said tab slots so that said tabs are bendable in said tab slots;

a fastener opening disposed in each of said tabs;

a series of pickets having a first distal end portion extending through said picket slots in said bottom wall of said upper rail and having an end surface abutting one of said tabs, and said pickets having a second distal end portion extending through said picket slots in said top wall of said lower rail and having an end surface abutting one of said tabs;

a fastener channel carried on an interior side of each of said pickets adjacent said end surface of said first and second distal end portions, wherein said fastener channel aligns with said fastener opening of said tab and a securing member extends through said fastener opening and into said fastener channel to secure each of said pickets to one of said tabs;

wherein said pickets pivot in said picket slots of said upper and lower rails causing said tabs to bend relative to a plane of said tab strip to allow said pickets and rails to rack to an angle.

9. The rackable railing assembly of claim 8 wherein said tabs extend in the same direction along said tab strips, and wherein said tab strips are oriented in both said upper and lower rails so that said tabs on both said tab strips extend in the same direction.

10. The rackable railing assembly of claim 8 wherein said first and second distal end portions of said pickets extend at least partially through said tab slots when said pickets pivot in said picket slots and said tabs are bent to an angle relative to said tab strip.

11. The rackable railing assembly of claim 8 wherein said picket slots and said tab slots are elongated in a direction along the length of said upper rail and said tab strip defining a pivot gap between said pickets and at least one end of each of said picket slots and said tab slots in said upper rail.

12. The rackable railing assembly of claim 8 wherein a rail cap is mounted to said upper rail that covers said open top side and includes a raised central portion extending over said open top side of said upper rail defining a receiving area between said plane defining said open top side of said upper rail and an interior surface of said rail cap, wherein said first distal end portion of said pickets and said tabs on said tab strip of said upper rail extend through said plane of said open top side and enter said receiving area when said pickets are pivoted.

13. A rackable railing assembly comprising:

a rail having a hollow interior defined by a first sidewall, a second sidewall, a bottom wall and an open top side extending along a plane disposed at and between the distal ends of the first and second sidewalls;

a series of picket slots disposed in said bottom wall of said rail;

a first channel carried on said first sidewall in said rail, and a second channel carried on said second sidewall in said rail opposite said first channel;

a tab strip disposed in said hollow interior and having a first side carried in said first channel and a second side carried in said second channel, wherein said tab strip is disposed adjacent said open top side;

a series of tab slots being laterally spaced along said tab strip;

a tab secured at one end of each of said tab slots and extending partially across said tab slots so that said tabs are bendable in said tab slots;

a series of pickets having a distal end portion extending through said picket slots in said rail and having an end surface secured against one of said tabs;

wherein said pickets pivot in said picket slots causing said tabs to bend relative to a plane of said tab strip to allow said pickets and rail to rack to an angle.

14. The rackable railing assembly of claim 13 including a fastener opening disposed in each of said tabs.

15. The rackable railing assembly of claim 14 including a fastener channel carried on an interior side of each of said pickets adjacent said end surface, wherein said fastener channel aligns with said fastener opening of said tab and a securing member extends through said fastener opening and into said fastener channel to secure each of said pickets to one of said tabs.

16. The rackable railing assembly of claim 13 wherein said distal end portion of said pickets extends at least partially through said tab slots when said pickets pivot in said picket slots and said tabs are bent to an angle relative to said tab strip.

17. The rackable railing assembly of claim 13 wherein said picket slots and said tab slots are elongated in a direction along the length of said rail and said tab strip defining a pivot gap between said pickets and at least one end of each of said picket slots and said tab slots.

* * * * *